US006371506B1

(12) United States Patent
DeNicola

(10) Patent No.: US 6,371,506 B1
(45) Date of Patent: Apr. 16, 2002

(54) WEDGE-SHAPED SHIMS FOR FREE HEEL SKIS

(76) Inventor: James A. DeNicola, 13840 Franklin St., Whittier, CA (US) 90602

( * ) Notice: Subject to any disclaimer, the term of this patent is extended or adjusted under 35 U.S.C. 154(b) by 0 days.

(21) Appl. No.: 09/570,839

(22) Filed: Aug. 4, 2000

(51) Int. Cl.[7] ..... A63C 9/00
(52) U.S. Cl. ..... 280/607; 280/617; 36/117.4
(58) Field of Search ..... 280/607, 609, 280/614, 615, 616, 617, 619, 621, 636; 36/117.3, 117.4, 117.2, 125

(56) References Cited

U.S. PATENT DOCUMENTS 3,822,491 A * 7/1974 Rathmell ..... 36/117.3
3,925,911 A * 12/1975 Erlebach ..... 36/117.4
4,067,593 A * 1/1978 Earl ..... 280/617
4,098,010 A * 7/1978 Rothmayer ..... 36/117.4
4,129,319 A * 12/1978 Strohmeier ..... 280/636
4,505,057 A * 3/1985 Kiester ..... 36/117.4
4,678,201 A * 7/1987 Williams ..... 280/620
4,997,198 A * 3/1991 Provence et al. ..... 280/615
5,090,723 A * 2/1992 Arnulf ..... 280/636
5,143,395 A * 9/1992 Mayr ..... 280/617
5,188,386 A * 2/1993 Schweizer ..... 280/607
5,435,588 A * 7/1995 Commier et al. ..... 280/607
5,655,787 A * 8/1997 Piegay ..... 280/617
5,669,622 A * 9/1997 Miller ..... 280/619
5,829,776 A * 11/1998 Deville et al. ..... 280/607
5,992,872 A * 11/1999 Proctor ..... 280/611

* cited by examiner

*Primary Examiner*—J. J. Swann
*Assistant Examiner*—Christopher Bottorff

(57) ABSTRACT

A set of three wedge-shaped shims per ski carefully designed to integrate the fit of free heel Nordic Norm, Three Pin, or 75 Millimeter ski boots to their bindings and skis. The front wedge-shaped shim allows the binding toepiece to slope upward to meet the boot's rocker shaped toe. The middle wedge-shaped shim supports the binding mid-foot plate (if so fitted) or the ball-of-the-foot boot sole. The rear wedge-shaped shim allows the binding heel plate to slope upward to meet the boot's heel. These three wedge-shaped shims are mounted between the (1) toepiece, (2) mid-foot plate (if so fitted) or ball-of-the-foot boot sole, (3) heel plate and the ski top respectively. The binding components are therefore fitted to the ski boot's rocker shaped sole and ski top. This allows the ski boots a perfect fit when clipped into the binding/wedge-shaped shim/ski system. This gives the skier maximum ski control, comfort, power and endurance while eliminating unwanted stress on the boot, binding, fasteners, and ski top.

1 Claim, 5 Drawing Sheets

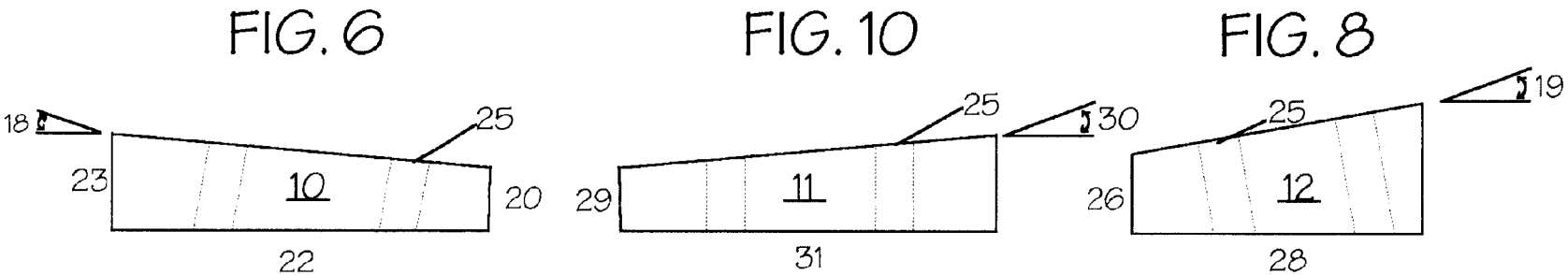
FIG. 6
FIG. 10
FIG. 8
10
11
12
18
19
20
22
23
25
26
28
29
30
31
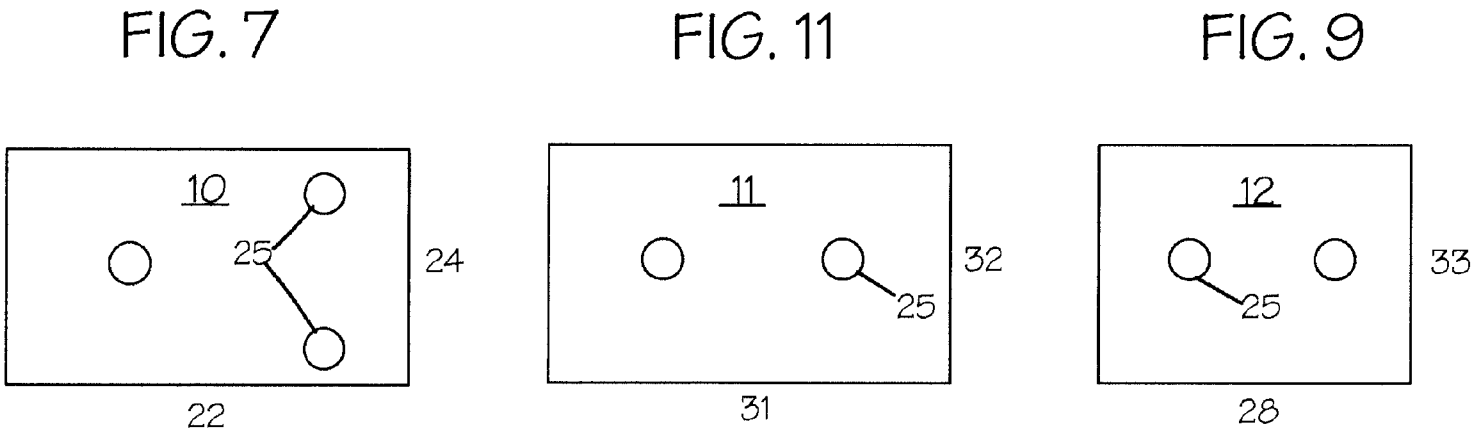
FIG. 7
FIG. 11
FIG. 9
10
11
12
22
24
25
28
31
32
33

WEDGE-SHAPED SHIMS FOR FREE HEEL SKIS

BACKGROUND OF THE INVENTION

Conventional free heel cross-country, backcountry touring, and telemark ski bindings are usually mounted flat and level to the ski top surface or on a flat and level shim some distance above the ski top. This flat/level to the ski top conflicts with the rocker shape ski boot sole design used by many boots. When a boot with a rocker shaped sole is clipped into such a flat/level mounted binding system the boot heel wants to float, unsupported, some distance above the ski because the toe is flat and level to the ski top. When the boot is weighted down in this condition and the boot heel is forced down into contact with the heel plate or ski top, a greater upward force is created at the boot toe. The reason this occurs is that the boot's rocker sole creates a fulcrum with the pivot at the ball-of-the-foot. Stiff boot soles transmit most of this increased leverage force from the heel to the toe because the boots do not flex down and flat. The boots are designed to only flex upward. The leverage ratio is the length rearward of the pivot divided by the length foreward of the pivot. For large boots this ratio is approximately 2 to 1. All this unwanted upward force at the boot toe has to be overcome by the skier's foot before effective downward forces can be transferred to the ski for skiing control. At best this is exhausting for the skier's muscles involved.

All this upward force at the toe produces unwanted stresses on the boot, binding, fasteners, and ski top. The boot toe pushes the binding toe bail/crossbar upward often causing bending or breakage. The toe bail/crossbar pulls the toepiece body and its fasteners upward often bending or stripping them. The upward pull on these fasteners can de-laminate the ski causing a separation of the ski top from the ski body.

BRIEF SUMMARY

This invention relates to snow ski equipment. In particular this invention relates to free heel cross-country, backcountry touring, and telemark boots, bindings and skis. Specifically, this invention relates to those boots and bindings known as Nordic Norm, Three Pin, and 75 Millimeter and the skis appropriately mated with them. Boots in this category feature a hiking boot's rocker type sole design because ski boots used for cross-country, backcountry touring and telemark skiing are often used for walking, hiking, and climbing while the skis are carried by the skier. This is the nature of free heel Nordic type skiing. Especially when accessing wilderness backcountry terrain.

The invention maximizes the utility of such rocker sole type free heel Nordic Norm, Three Pin, and 75 Millimeter boots by the use of a fully integrated boot/binding/wedge-shaped shim/ski system. The wedge-shaped shims allow the mating of all commercially available sizes and styles of Nordic Norm, Three Pin, and 75 Millimeter type boots and bindings to appropriate skis. Boots may be low cut or high cut and with laces or buckles. Bindings may be Three Pin type or Cable Type. Cable Type may be front throw, side throw or rear throw. This unique system of wedge-shaped shims provides many performance benefits.

OBJECTS OF THE INVENTION

1. It is the object of this invention to preserve the rocker sole shape of free heel ski boots when mounted in the boot/binding/wedge-shaped shim/ski system by preventing distortion of the boot.

2. It is the further object of this invention to allow a natural toe/foot position inside the boot. The toes follow the rocker sole shape and are raised up a few degrees above flat and level. This natural toe/foot position provides comfort, power, and endurance.
3. It is the further object of this invention to eliminate unwanted stress on the boot.
4. It is the further object of this invention to eliminate unwanted stress on the binding and its fasteners.
5. It is the further object of this invention to eliminate unwanted stress on the ski top.
6. It is the further object of this invention to provide a solid interface between the ski and the boot's toe, ball-of-the-foot, and heel.
7. It is the further object of this invention to provide increased leverage to control the ski by raising the boot sole some predetermined height above the ski top by the use of three wedge-shaped shims.
8. It is the further object of this invention to decrease binding drag on the snow by raising and angling the front leading edge of the binding.
9. It is the further object of this invention to increase the skiing performance of all commercially available Nordic Norm, Three Pin and 75 Millimeter boots, bindings and their appropriate skis.

DESCRIPTION OF THE DRAWINGS

FIG. 6 is a side view of the front wedge-shaped shim

FIG. 7 is a top view of the front wedge-shaped shim.

FIG. 8 is a side view of the rear wedge-shaped shim.

FIG. 9 is a top view of the rear wedge-shaped shim.

FIG. 10 is a side view of the middle wedge-shaped shim.

FIG. 11 is a top view of the middle wedge-shaped shim.

DETAILED DESCRIPTION OF PREFERRED EMBODIMENTS

In the following specifications this invention has been described in relation to certain preferred embodiments. It is apparent that the invention is susceptible to additional embodiments and that certain details can be varied considerably without departing from the basic principles of this invention.

The skier's choice of particular boots, bindings, and skis requires careful consideration of the compatibility of these inter-related components and their suitability for the skiing application for which they are chosen. The amount of lift of the wedge-shaped shims can be low for low boots or high for higher boots with buckles, depending upon the skier's choice of components. Once the components are selected the set of three wedge-shaped shims can be designed to perfectly mate everything into a fully integrated system.

Figure 1:
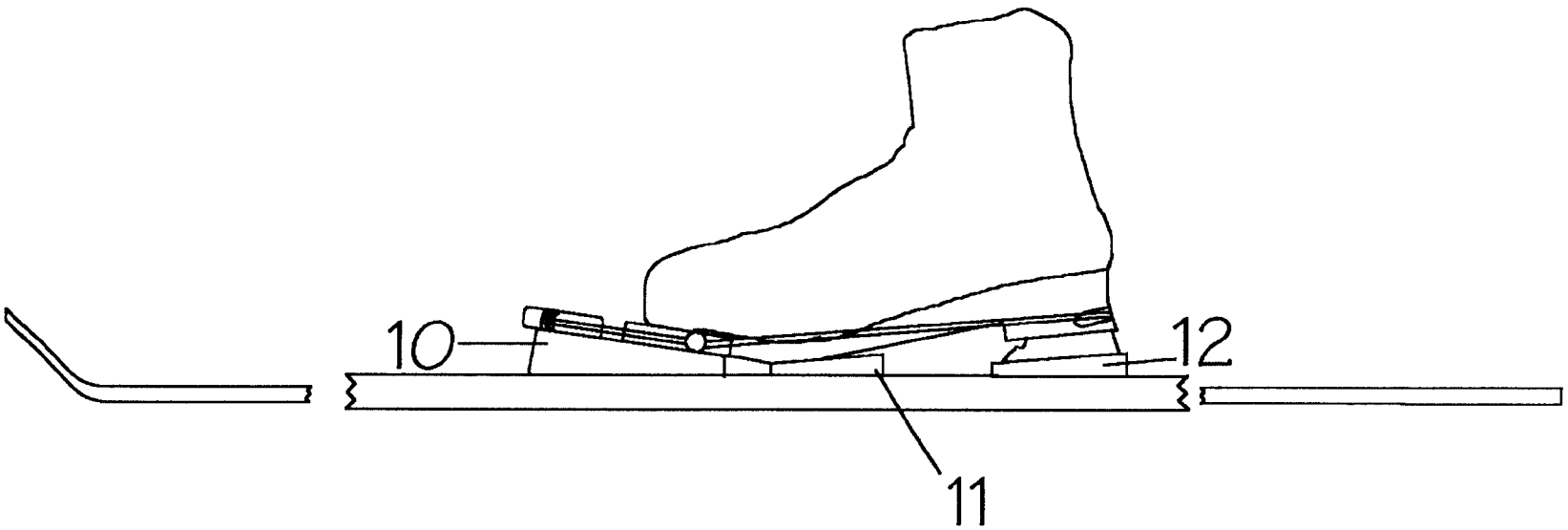
FIG. 1 is a view of a ski set up showing a preferred embodiment of the integrated system of boot/binding/wedge-shaped shim/ski system.

Referring now to FIG. 1 there is shown the boot/binding/wedge-shaped shim/ski system showing the front wedge-shaped shim 10, the middle wedge-shaped shim 11, and the rear wedge-shaped shim 12.

Figure 2:
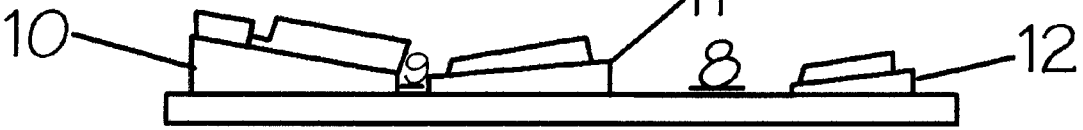
FIG. 2 is a side view of a binding and wedge-shaped shims on a ski section.

Referring now to FIG. 2 the dimensions of each wedge-shaped shim are determined by the skier's chosen boot, toepiece, mid-foot plate (if so fitted), heel plate and ski dimensions. The size and shape of each wedge-shaped shim is carefully engineered to intermember with all the components selected. The wedge-shaped shims are designed to fit the three spaces: (1) between the toepiece and ski is the front wedge-shaped shim 10; (2) between the mid-foot plate (if so fitted) or boot sole at the ball-of-the-foot and ski is the middle wedge-shaped shim 11; (3) between the heel plate and ski is the rear wedge-shaped shim 12. A gap 9 between the front wedge-shaped shim 10 and middle wedge-shaped shim 11; and a gap 8 between the middle wedge-shaped shim 11 and rear wedge-shaped shim 12 will minimize the wedge-shaped shims overall sizes, while allowing snow trapped underfoot to squeeze out.

Figure 3:
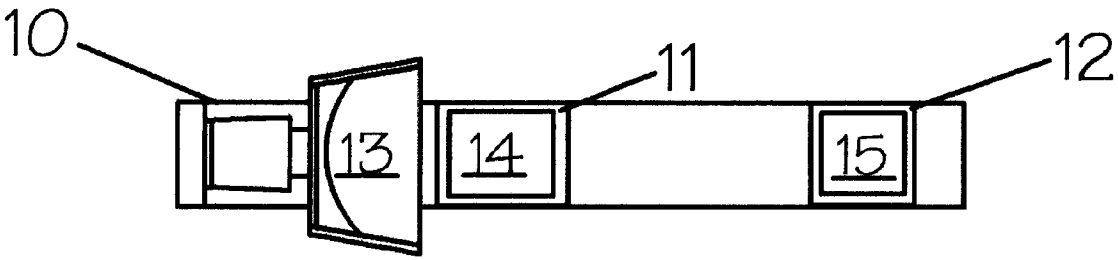
FIG. 3 is a top view of a binding and wedge-shaped shims on a ski section.
Figure 12:
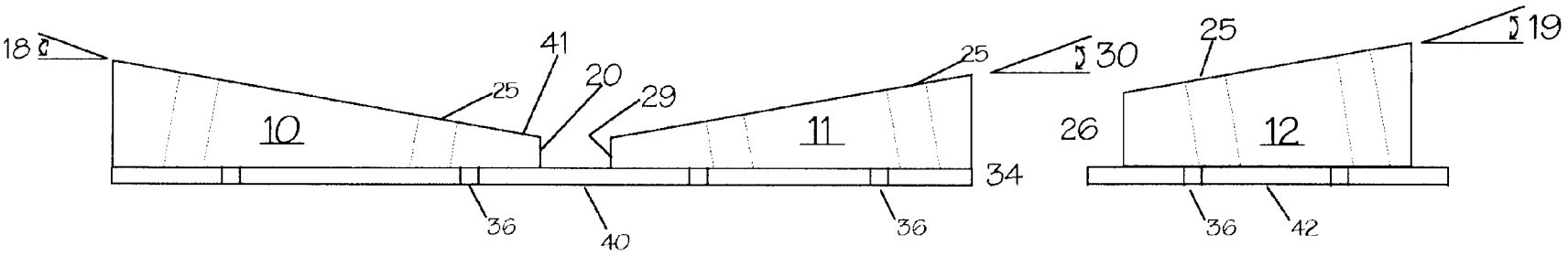
FIG. 12 is a side view of front and middle wedge-shaped shims on a common mounting plate, and the rear wedge-shaped shim on a mounting plate.
Figure 13:
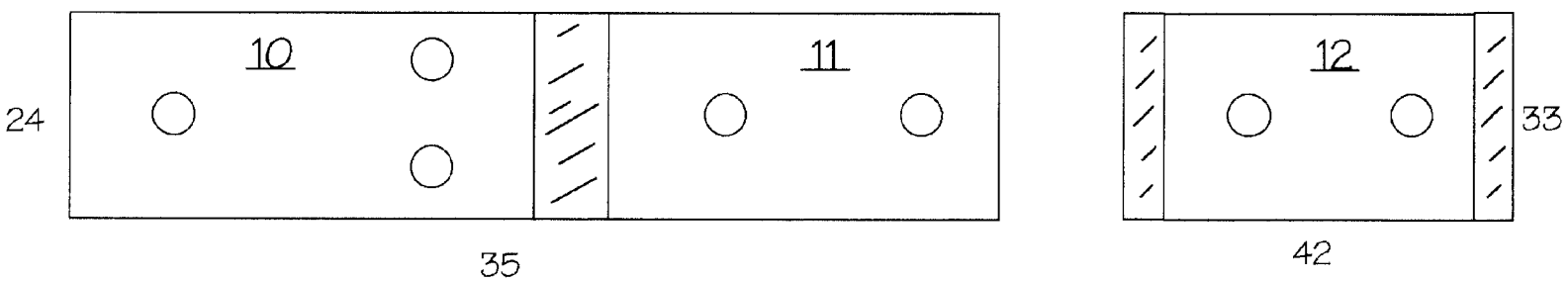
FIG. 13 is a top view of front and middle wedge-shaped shims on a common mounting plate, and the rear wedge-shaped shim on a mounting plate.

Referring now to FIG. 3 the toepiece 13 is positioned on the ski according to the guidelines established by the manufacturer. The toepiece 13 is wider than the ski. The front wedge-shaped shim 10 should equal the ski width at its mounting location. The middle wedge-shaped shim 11 may or may not require a mid-foot plate 14 depending on the skier's chosen equipment. The middle wedge-shaped shim 11 should be equal to the ski width at its mounting location. This will allow maximum transfer of boot pressure to the ski and its edges. The rear wedge-shaped shim 12 supports a heel plate 15 that is normally supplied with the binding. Often this heel plate comes with a device that elevates the boot heel for uphill climbing purposes. This uphill climbing device is often a wire bail that flips up into place when needed for climbing then it folds back down out of the way or removed when not needed. The rear wedge-shaped shim should provide for the use of such devices when shaping and sizing the rear wedge-shaped shim 12. These wedge-shaped shims can be mounted directly to the ski top. Other embodiments can include the front and middle, or all three of these wedge-shaped shims mounted to a common mounting plate. FIG. 12 and FIG. 13 illustrate the front and middle wedge-shaped shims mounted to a common mounting plate 40, and the rear wedge-shaped shim mounted to a rear mounting plate 42.

Figure 4:
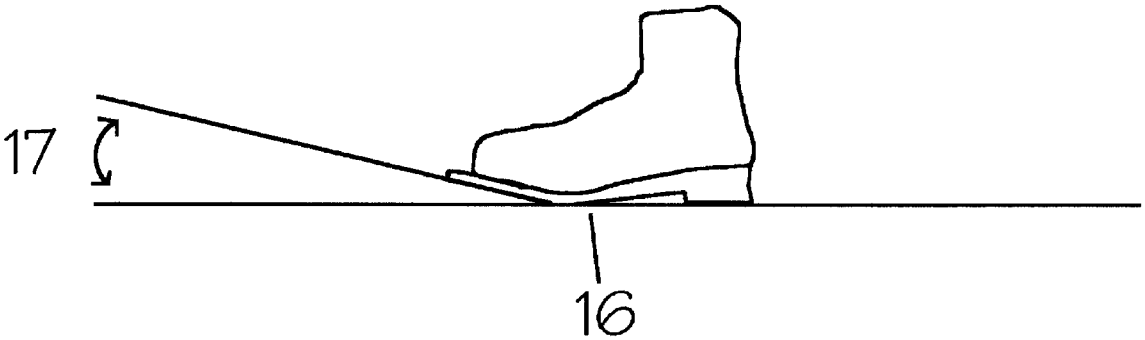
FIG. 4 is a side view of a ski boot showing the total wedge-angle.

Referring now to FIG. 4 the total wedge angle 17 of a rocker type boot sole is measured by placing the boot on a flat surface and measuring the angle under the toe from the ball-of-the-foot 16 foreward to the tip of the boot toe.

Figure 5:
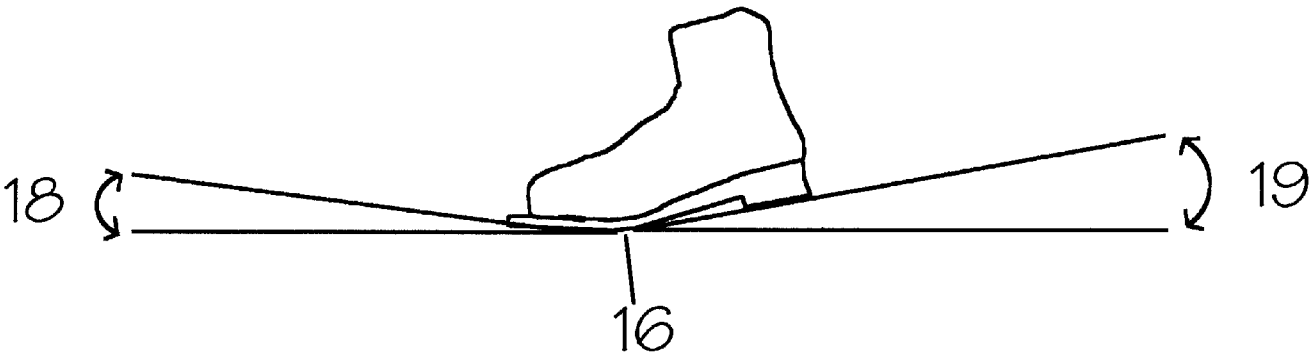
FIG. 5 is a side view of a ski boot showing front and rear wedge angles.

Referring now to FIG. 5 the front wedge angle for the front wedge-shaped shim 18 and the rear wedge angle for the rear wedge-shaped shim 19 add up to equal the total wedge angle in FIGS. 4–17. The skier's chosen boot design and the skier's preferences shall determine the relative relationships between the front wedge angle 18 and the rear wedge angle 19. The front and rear wedge angles may be equal or the boots may be favored to lean foreward or rearward by adjusting the front and rear wedge angles.

Referring now to FIG. 6 the vertical dimensions of the front wedge-shaped shim 10 can be divided into two components (1) the height/lift 20 of the wedge-shaped shim and (2) the front wedge angle 18 as shown in FIGS. 5–18. The length 22 of the front wedge-shape shim needs to be large enough to support the skier's chosen toepiece. The size 23 of the front wedge-shaped shim is determined by the factors of height/lift 20, angle 18, and the length 22. This leading surface 23 may be shaped to divert snow, provide access for front throw mechanisms and/or to provide an aesthetic appearance to the mounting.

Referring now to FIG. 7 the width 24 of the front wedge-shaped shim 10 is determined by the ski width to which it is equal. The length 22 should be just enough to properly support the toepiece. Fastener pilot holes 25 should be perpendicular to the toepiece so the screw heads will lie flush and not hinder boot entry and exit. Fastener dimensions and pilot hole dimensions need careful selection and installation for reliability.

Referring now to FIG. 8 the vertical dimension of the rear wedge-shaped shim 12 is the sum of two critical components (1) the height/lift 26 of the rear wedge-shaped shim, and (2) the rear wedge angle 19 as shown in FIGS. 5–19. The length 28 of the rear wedge-shaped shim should be large enough to fully support the skier's chosen heel plate FIGS. 3–15. Therefore, the overall size of this critical rear wedge-shaped shim will be determined by the factors of height/lift 26, angle 19, and length 28. The design goal requires a balance between the front FIGS. 6–20 and rear FIGS. 8–26 wedge-shaped shims. When the boot is clipped into the binding FIGS. 3–13 the boot's heel should contact the heel plate FIGS. 3–15 which is mounted on top of the rear wedge-shaped shim 12. The amount of height/lift chosen by the skier shall be defined as the height of the front wedge-shaped shim FIGS. 6–20. The height of the dependent rear wedge-shaped shim will normally be higher.

Referring now to FIG. 9 the width 33 of the rear wedge-shaped shim is determined by the heel plate FIGS. 3–15 chosen by the skier. The width should be at least equal to the heel plate and not wider than the ski width. The rear wedge-shaped shim should not interfere with any climbing bails/mechanisms and may require notching or shaping to fit the heel plate. The fasteners may require installation perpendicular to the heel plate in order for the screws to fit flush in the screw openings provided in the heel plate. The length 28 of the rear wedge-shaped shim shall be at least as long as the heel plate.

Referring now to FIG. 10 the middle wedge-shaped shim 11 is dependent upon the front wedge-shaped shim FIGS. 6–20 and the rear wedge-shaped shim FIGS. 8–26 for its height/lift 29. The purpose of the middle wedge-shaped shim is to support the boot's ball-of-the-foot sole section. Therefore, the middle wedge-shaped shim should be fitted last, after the mounting to the ski of the front and rear wedge-shaped shims. To determine the necessary dimensions of the middle wedge-shaped shim the boot should be clipped into the binding and weighted onto the heel plate. The space under the ball-of-the-foot sole section needs to be filled by the combination of both the middle wedge-shaped shim and a mid-foot plate FIGS. 3–14 (if so fitted). The mid-foot plate and middle wedge-shaped shim can carry some of the lateral forces created skiing and take some of the load of the skiing forces off the toepiece and its fasteners. The middle wedge angle 30 may be different from the front and rear wedge-shaped shims. The middle wedge-shaped shim 11 must fully support the ball-of-the-foot boot sole section (through a mid-foot plate if so fitted) in order to transfer maximum skiing control forces to the ski. The length 31 of the middle wedge-shaped shim should be large enough to support a mid-foot plate (if so fitted). If a mid-foot plate is not chosen then the length 31 shall be approximately equal to the width FIGS. 11–32.

Referring now to FIG. 11 the purpose of the middle wedge-shaped shim 11 is to support the ball-of-the-foot boot sole section (through a mid-foot plate if so fitted) and to transfer skiing control forces to the ski, especially the ski edges. The width 32 of the middle wedge-shaped shim should be equal to the ski width. If a mid-foot plate is to be mounted on top of the middle wedge-shaped shim 11 it should be very close in width to the middle wedge-shaped shim, but not wider. The fasteners may require installation perpendicular to the mid-foot plate in order for the screw heads to fit flush.

Referring now to FIG. 12 mounting plates can offer versatility. The mounting plate can use existing fastener hole positions 36 in the ski top to mount the plate to the ski. The wedge-shaped shims can be mounted to the mounting plate. This eliminates unwanted extra holes in the ski top. This gives the skier the ability to experiment with different mounting positions of the binding on the ski or to experiment with different bindings that may have different fastener patterns 25 without unnecessary extra pilot holes in the ski top. It is recognized that too many pilot holes in the ski top can weaken the ski and cause diminished ski value. A common mounting plate 40 may be used for unitizing the front 10 and middle 11 wedge-shaped shims. A similar rear mounting plate 42 may be mounted under the rear wedge-shaped shim 12. The thickness 34 of the common mounting plate is taken into consideration when designing the overall height/lift of the unitized wedge-shaped shims. The height shall be defined as the height/lift 20 of the front wedge-shaped shim plus the height/lift 34 of the common mounting plate. The sum of these two items represents the height/lift 41 above the ski top that defines the height/lift leverage chosen by the skier when selecting components for the boot/binding/wedge-shaped shim/ski system. The height/lift 26 of the rear wedge-shaped shim will include the dimension of the plate 42. Depending upon the size of the boot and the front and rear wedge angles, the height/lift 26 of the rear shim and plate 42 is often larger than the height/lift 20 of the front shim plus the plate 40. Small size boots are a few inches shorter in overall length than large size boots. The position of the heel plate is dependent on the size of the boot. For smaller boots the heel plate mounts closer to the toepiece. With larger boots the heel plate mounts farther away from the toepiece. Ski length is proportional to skier size and weight. However, a given ski may be suitable for skiers with boot sizes that vary a couple of inches in length. Therefore, it may be desirable to move the rear wedge-shaped shim and heel plate foreward and rearward on the ski to allow for different boots to properly fit the boot/binding/wedge-shaped shim/ski system. A rear mounting plate 42 for the rear wedge-shaped shim can have extra sets of fastener pilot holes which allow the wedge-shaped shim to mount foreward or rearward on the rear mounting plate to accommodate different size boots.

Referring now to FIG. 13 the length 35 of the common mounting plate 40 is determined by the size of the skier's chosen boot with adjustments for the toepiece and mid-foot plate dimensions. The common mounting plate needs to fully support the toepiece and mid-foot plate according to the manufacturer guidelines. The width 24 of the common mounting plate should equal the width of the ski. The length of the rear mounting plate 42 for the rear wedge-shaped shim should allow moving the rear wedge-shaped shim foreward and rearward to fit different size boots that are planned to be used in the boot/binding/wedge-shaped shim/ski system. The width 33 of the rear mounting plate 42 should be at least as wide as the heel plate but not wider than the ski at its mounting position.

I claim:

1. A free heel binding mounting apparatus for mounting a ski boot to a ski, wherein the ski boot has a rocker shaped sole, the binding mounting apparatus comprising:

a common mounting plate adapted to be mounted on the ski;

a front wedge-shaped shim that mounts under a binding toepiece and on the common mounting plate a middle wedge-shaped shim that mounts under a binding mid-foot plate and on the common mounting plate;

a rear mounting plate spaced apart from the common mounting plate and adapted to be mounted on the ski;

a rear wedge-shaped shim that mounts under a binding heel plate and on the rear mounting plate, wherein the rear mounting plate provides several different mounting positions for the rear wedge-shaped shim.

* * * * *